US009332334B2

(12) United States Patent
Chardon et al.

(10) Patent No.: US 9,332,334 B2
(45) Date of Patent: May 3, 2016

(54) MOBILE COMMUNICATIONS DEVICE CASE

(71) Applicant: Logitech Europe SA, Morges (CH)

(72) Inventors: Jean-Michel Chardon, Vufflens-la-Ville (CH); Remy Zimmermann, Pully (CH)

(73) Assignee: Logitech Europe S.A., Morges (CH)

( * ) Notice: Subject to any disclaimer, the term of this patent is extended or adjusted under 35 U.S.C. 154(b) by 0 days.

(21) Appl. No.: 14/043,874

(22) Filed: Oct. 2, 2013

(65) Prior Publication Data

US 2014/0233783 A1 Aug. 21, 2014

Related U.S. Application Data

(60) Provisional application No. 61/765,644, filed on Feb. 15, 2013.

(51) Int. Cl.
*H04R 25/00* (2006.01)
*H04R 1/10* (2006.01)

(52) U.S. Cl.
CPC ..... *H04R 1/1033* (2013.01); *H04R 1/10* (2013.01); *H04R 2205/022* (2013.01); *H04R 2499/11* (2013.01)

(58) Field of Classification Search
CPC ..... H04R 2499/11; H04R 1/10; H04R 2205/022; H04R 1/1033
USPC ..... 379/430, 437, 451; 381/384; 455/556.1, 455/569.1, 575.8
See application file for complete search history.

(56) References Cited

U.S. PATENT DOCUMENTS 1,859,646 A 5/1932 Apfelbaum
3,095,668 A 7/1963 Dorsett
3,868,085 A 2/1975 Bentley (Continued)

FOREIGN PATENT DOCUMENTS

CN 202065633 U 12/2011
CN 104373785 A 2/2015

OTHER PUBLICATIONS

Intel Corporation, High Definition Audio Specification, Specification, Jun. 17, 2010, rev. 1.0a.

(Continued)

*Primary Examiner* — Matthew Eason
*Assistant Examiner* — Sean H Nguyen
(74) *Attorney, Agent, or Firm* — Kilpatrick Townsend & Stockton LLP

(57) ABSTRACT

A case for a mobile communications device is provided that is configurable to take on at least two audio/audible configurations. The first audio/audible configuration is a handset configuration and the second audio configuration is a headphone/earphone/earbud configuration. The case has a housing and a headphone male connector. The headphone male connector forms part of a headphone male connector assembly. The headphone male connector assembly is capable of moving the headphone male connector to selectively and/or mechanically engage a mobile communications device headphone port to actuate the first audio/audible configuration in a first position, and to actuate the second audio/audible configuration in a second position. A method of switching between different modes of operation of a mobile communications device, such as an iPhone™ smartphone, using the functionality of a removable, protective case for the device is also provided herein.

13 Claims, 4 Drawing Sheets

(56) References Cited

U.S. PATENT DOCUMENTS

| | | | | |
|---|---|---|---|---|
| 4,392,323 | A | 7/1983 | Rubik | |
| 5,497,971 | A | 3/1996 | Spiro | |
| 7,568,668 | B2 | 8/2009 | Taekema et al. | |
| 7,712,719 | B2 | 5/2010 | Derry et al. | |
| 2009/0098339 | A1 | 4/2009 | Marceau | |
| 2009/0221333 | A1 | 9/2009 | Harvey | |
| 2011/0170252 | A1 | 7/2011 | Jones et al. | |
| 2011/0233078 | A1* | 9/2011 | Monaco et al. | 206/223 |
| 2011/0293923 | A1 | 12/2011 | Schmidt et al. | |
| 2012/0001045 | A1 | 1/2012 | Wang | |
| 2013/0010986 | A1* | 1/2013 | Annacone | 381/123 |
| 2013/0265702 | A1* | 10/2013 | Merenda | 361/679.01 |
| 2014/0099905 | A1* | 4/2014 | Jimenez | 455/90.2 |
| 2014/0206238 | A1* | 7/2014 | Yen et al. | 439/668 |
| 2014/0231614 | A1 | 8/2014 | Chardon et al. | |

OTHER PUBLICATIONS

Microsoft Corporation, Universal Architecture (UAA) High Definition Audio class driver version 1.0a, Microsoft Knowledge Base Article 888111. Sep. 11, 2011, rev. 8.0.

The Freebsd Project, snd_hda—Intel High Definition Audiobridge device driver, Internet Citation, Jan. 25, 2012.

Openbsd.org, azalia—generic High Definition Audio sevice, Internet Citation, Mar. 15, 2012.

Realtek Semiconductor Corp., ALC888 Product Page, Internet Citation, 2009.

Conexant, PC HD-Audio, catalog, 2012.

Intel Corporation, Front Panel I/O Connectivity Design Guide, Specification, Feb. 2005, p. 19-25, rev. 1.3.

Intel Corporation, Intel (R) High Definition Audio, Internet Citation.

Intel Corporation, Front panel audio header pinouts, Internet Citation.

Intel Corporation, Motherboard Layout Guidelines for Optimal Audio Fidelity, Internet Citation.

Non-final Office Action, dated Feb. 6, 2015, for U.S. Appl. No. 14/068,097, filed Oct. 31, 2013, 23 pages.

Final Office Action, dated Aug. 5, 2015, for U.S. Appl. No. 14/068,097, filed Oct. 31, 2013, 23 pages.

Chinese First Office Action dated Dec. 25, 2015 for CN Application No. 201310351744.3, with English Translation, 4 pages.

* cited by examiner

MOBILE COMMUNICATIONS DEVICE CASE

CROSS REFERENCE TO RELATED APPLICATIONS

This application claims the benefit of U.S. Provisional Application 61/765,644, entitled ASSESSORIES FOR MOBILE DEVICES, filed 15 Feb. 2013, the content of which are incorporated herein by reference thereto.

COPYRIGHT & LEGAL NOTICE

A portion of the disclosure of this patent document contains material which is subject to copyright protection. The Applicant has no objection to the facsimile reproduction by anyone of the patent document or the patent disclosure as it appears in the Patent and Trademark Office patent file or records, but otherwise reserves all copyright rights whatsoever. Further, no references to third party patents or articles made herein is to be construed as an admission that the present invention is not entitled to antedate such material by virtue of prior invention.

BACKGROUND OF THE INVENTION

This invention relates to accessories for mobile devices including smartphones, tablet computers, cellular phones, personal data assistants, media players, and the like, and more particularly to cases for electronic mobile devices such as tablet computers and mobile phones, e.g. Apple brand iPhone™ smartphones, and the like.

Portable device protective cases exist that include a flexible material jacket conformably surrounding at least a portion of the periphery of the portable device and a rigid rim conformably surrounding the jacket that may include one or more hinges and a snap lock to encase the jacket and the portable device surrounded therein. The functionality of the portable device is generally accessible through apertures and contacts in the jacket and rim so that no accessory tools or affixing devices are required to install the portable device in the case.

Similarly, cases exist for portable, handheld electronic devices such as those manufactured by Apple Inc., including the iPod™ touch, iPad™ and/or the iPhone™ which functional properties which are not present no a particular model of the portable, handheld electronic device by providing an integrated speaker and/or microphone and/or at least one camera, in addition to providing the usual protective and/or cushioning aspects of an ordinary case.

There are many problems with current cases for mobile electronic devices which involve audio modes of operation of mobile electronic devices. One of problems is that they do not provide a way of a user to quickly switch between different audio modes of operation of a mobile device. For example, if the user has the device in her purse and a call comes in, and she wishes to have privacy for the call by way of her headphones, the user may lose the call in the time it takes her to find her headphones, unravel them, and insert the male connector into the mobile device. The problem is compounded if the user has lost or has forgotten her earbuds. By way of further example, if a user is using earbuds and listening to music using his or her mobile device, and a call comes in and the user wishes to change to handset mode, the user may lose the call if he or she is not fast enough to activate the proper mobile phone audio mode of operation.

What is needed is a case for a mobile electronic device case, and a method that overcomes the shortcomings of the art.

SUMMARY OF THE INVENTION

The present invention provides a case for a mobile communications device configurable to take on at least two audio/audible configurations. The first audio configuration is a handset configuration and the second audio configuration is a headphone configuration. The case has a housing and includes a headphone, e.g. an earbud or earphone. The headphone male connector forms part of a headphone male connector assembly. The headphone male connector assembly is capable of moving the headphone male connector to selectively and mechanically engage a mobile communications device headphone port or socket to actuate the first audio configuration in a first position, and to actuate the second audio configuration in a second position.

In another variant, the headphone male connector assembly is configured to move the headphone male connector a distance in the range of about 1 millimeter to about 2 millimeters within the mobile communications device headphone port.

In yet another aspect, the headphone male connector assembly is communicatively linked to an earbud assembly. The earbud assembly is optionally sized and dimensioned to fit within a cavity on the housing. Optionally, the housing includes a rechargeable battery for supplying auxiliary power to the mobile communications device and the headphone male connector assembly is communicatively linked to an earphone port located on housing at a location other than the headphone male connector assembly.

In yet a further variant, the headphone male connector assembly includes a mechanical slide mechanism to actuate movement of the headphone male connector. The mechanical slide mechanism is located on a first side of the housing, and the headphone male connector is located on a second side of the housing. Alternatively, the mechanical slide mechanism and the headphone male connector assembly are co-located on a side of the housing.

In yet another embodiment, the headphone male connector assembly includes a rotational actuator, wherein rotational movement of actuator moves the headphone male connector in translation.

In yet another aspect, the invention includes a method which uses a case for an electronic communications device for switching between an earphone or earbud mode of operation and a phone handset mode of operation. The case for the mobile communications device is configurable to take on at least two audio configurations. The first audio configuration is a handset configuration and the second audio configuration is an earphone or earbud configuration. The case has a housing and a headphone male connector. The headphone male connector forms part of a headphone male connector assembly, and the headphone male connector assembly is capable of variably moving the headphone male connector between at least two positions in a port. The method includes providing for selective movement of the headphone male connector a predetermined distance in the mobile communications device headphone port to actuate the first audio configuration at a first position, and to actuate the second audio configuration at a second position. The selective movement includes rotational movement of a rotational actuator resulting in translational movement of the male connector in one variant. In another variant, the selective movement includes lateral movement via a mechanical slide assembly so that the headphone male connector moves in a direction perpendicular to the lateral movement. In yet another variant, the selective movement includes translational movement via the slide assembly to achieve parallel movement of the headphone male connector in the port.

In yet another embodiment, the method includes providing a cable management system on the housing. The cable management system includes a cavity for storing an earphone/earbud assembly. Optionally, the cable management system further comprises a manually activated automatic retrieval system for the earbud assembly, in which the earbud assembly is communicatively linked to the headphone male connector assembly.

In yet another variant, the invention provides an audio management method which uses the combination of a mobile communications device and a protective case. The protective case removably fits the mobile communications device, and the method includes the step of selectively switching between an earbuds/earphone mode of operation and a phone handset mode of operation via mechanical movement of a headphone male connector in a port on the mobile communications device, in which the headphone male connector forms part of a headphone male connector assembly of the protective case. The method optionally includes assisting in picking up a call as a result of the mechanical movement.

The preceding summary of the invention is not intended to limit the scope of the invention in any way as the summary is exemplary in nature. Consequently, changes may be made in the arrangement and/or function of any of the elements described in the summary disclosed herein without departing from the spirit and scope of the invention.

Figure 1:
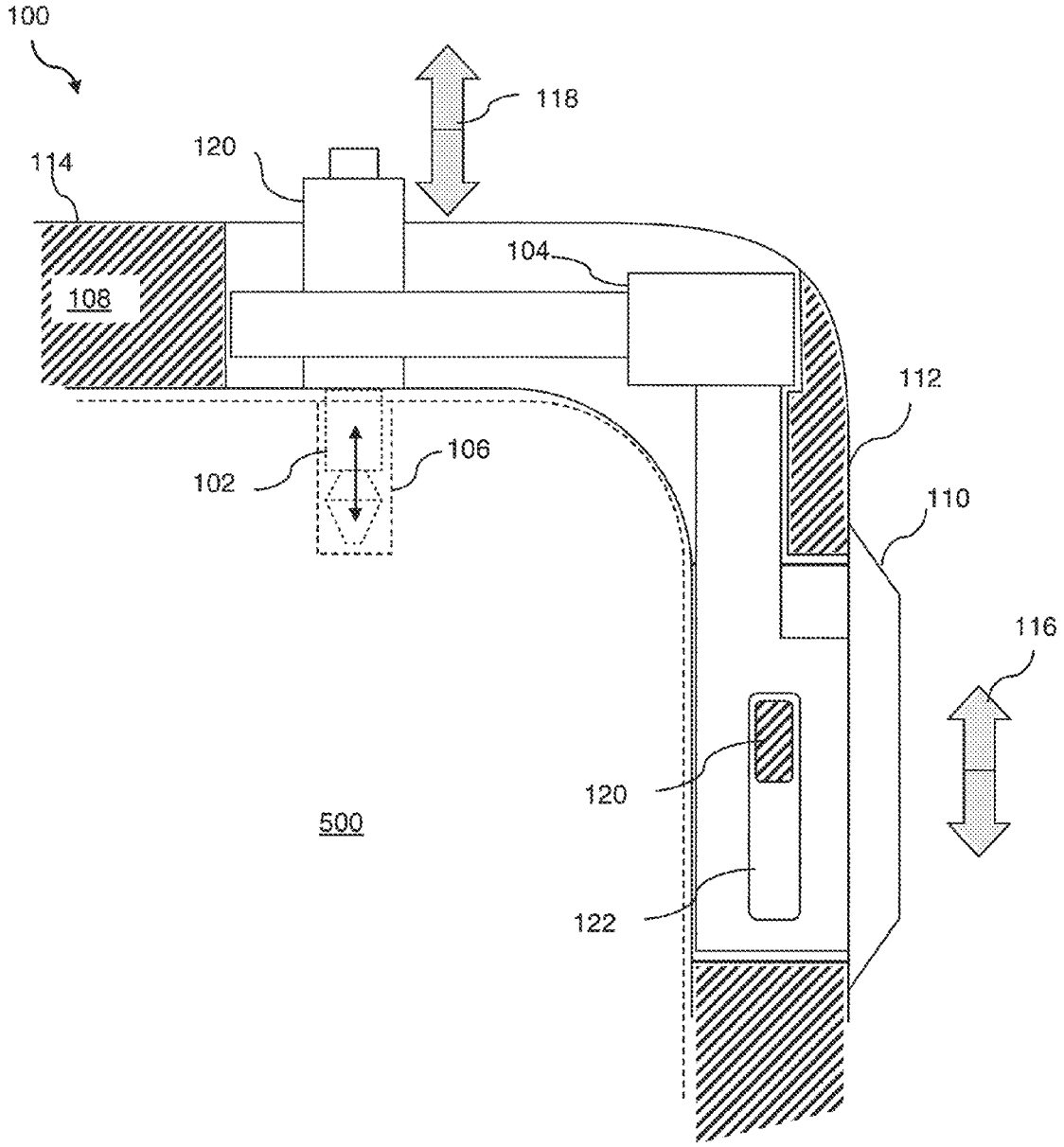
FIG. 1 is a partial front cut away view of a first variant of a mobile communications device case of the invention.

Those skilled in the art will appreciate that elements in the Figures are illustrated for simplicity and clarity and have not necessarily been drawn to scale. For example, dimensions may be exaggerated relative to other elements to help improve understanding of the invention and its embodiments. Furthermore, when the terms 'first', 'second', and the like are used herein, their use is intended for distinguishing between similar elements and not necessarily for describing a sequential or chronological order. Moreover, relative terms like 'front', 'back', 'top' and 'bottom', and the like in the Description and/or in the claims are not necessarily used for describing exclusive relative position. Those skilled in the art will therefore understand that such terms may be interchangeable with other terms, and that the embodiments described herein are capable of operating in other orientations than those explicitly illustrated or otherwise described.

DETAILED DESCRIPTION OF THE PREFERRED EMBODIMENT

The following description is not intended to limit the scope of the invention in any way as they are exemplary in nature, serving to describe the best mode of the invention known the inventors as of the filing date hereof. Consequently, changes may be made in the arrangement and/or function of any of the elements described in the exemplary embodiments disclosed herein without departing from the spirit and scope of the invention.

As illustrated in FIGS. 1-4, the invention provides cases 100, 200, 300, 400 for a mobile communications device 500. The cases are configurable to take on at least two audio/audible configurations. Typical mobile communications devices include Apple™ IPhone™ mobile phones (Series 1-5), Apple™ iPad™ tablet computers, and the cases are sized and dimensioned to snugly fit the exterior housings of the mobile phones/tablets and removably lock them into place. Exemplary mobile devices are small, handheld computing devices, generally including a display screen with touch input and/or a miniature keyboard and weighing much less than 1 kg. Devices manufactured by Apple, Samsung, Sony, Nokia, HTC, LG, and Research in Motion (RIM) are just a few examples of these types of devices.

Typical devices include an operating system (OS), and can run various types of application software, known as apps. The mobile operating systems used by modern smartphones include Google's Android, Apple's iOS, Nokia's Symbian, RIM's BlackBerry OS, Samsung's Bada, Microsoft's Windows Phone, Hewlett-Packard's webOS, and embedded Linux distributions such as Maemo and MeeGo. Most of these devices are also equipped with Bluetooth, and GPS capabilities that allow connections to the Internet and other Bluetooth-capable devices.

The cases 100, 200, 300, 400 are constructed either from hard polymeric or soft polymeric materials, or a combination of soft and hard polymeric materials for protection of the mobile phone and for safe user grip. Of course, it is appreciated that other materials are also used for case construction including metals, composites, and fabrics. Various colors and finishes of the cases are also provided. The devices include modes of operation that include phone handset modes, and headphone/earphone/earbud modes.

Figure 2:
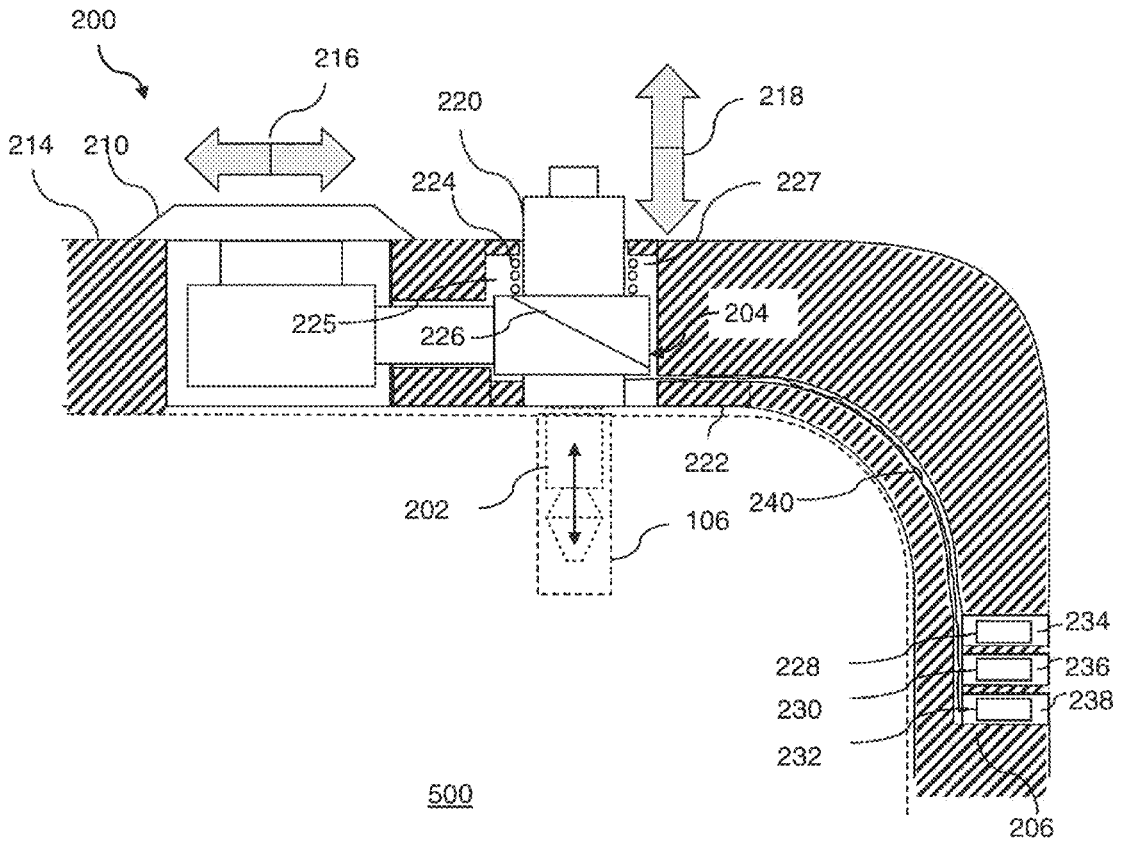
FIG. 2 is a partial front cut away view of a second variant of a mobile communications device case of the invention.

In the present invention, the first audio configuration is a handset configuration and the second audio configuration is a headphone/earphone/earbud configuration. As used herein, the term "headphone" includes all types of handsets worn on one or more ears of a user or in one or more of the ear canals of a user. Indeed, the invention is adapted to allow use of several or a plurality of disparate, different, types of earphone standard connectors or audio jacks (female connectors releasably mating to male connectors) (see female connectors 234, 236, 238 as illustrated in FIG. 2) in one variant of the invention. In another variant of the invention, the plurality of connectors are of the same type of connector. It is appreciated that this is particularly useful when two users wish to listen to the same mobile phone conversation or listen to the same audio media from a single mobile communications/digital playback device. As is the case currently, users are forced to share a single earphone speaker from the right and left pair that comes with these standard devices. In this way, each user can use both the left and right speakers of an earbud/headphone through the use of a respective port 234, 236, 238. The cases 100, 200, 300, 400 illustrated in FIGS. 1-4, each include a respective housing 108, 208, 308, 408. The cases include a headphone male connector 102, 202, 302. The headphone male connector is typically an earbud male connector or a larger headphone male connector. The male connectors are standard phone earbud/earphone/headphone connectors in one variant of the invention. By way of example, three-conductor or four-conductor (TRS or TRRS) 2.5 mm and 3.5 mm male connectors are used in sockets or ports on cell phones, providing mono (three conductor) or stereo (four conductor) sound and a microphone input, together with optional signaling (e.g., push a button to answer a call). Three-conductor 2.5 mm connectors are particularly common on older phones, while four-conductor 3.5 mm connectors are more common on smartphones used in the invention. By way of further example, 3.5 mm TRRS (stereo-plus-mic) male connectors and sockets are common on smartphones. Two different variants are frequently found, both of which place left audio on the tip and right audio on the first ring (mirroring the configuration found on stereo connectors). The first, which places the return signal on the second ring and the microphone on the sleeve, is used by Apple's iPhone™ smartphone line, HTC™ devices, Samsung™, Nokia™ and Sony™ smartphones, for example. The second, which reverses these contacts, is used by older Nokia mobiles, some Samsung™ smartphones and some Sony Ericsson™ phones. It is appreciated that various male connectors (male components) and ports (female components) in addition to those described herein are used in other variants of the invention.

It is further appreciated that connectors 102, 202 and 302 are also referred to as audio jacks, and that the assemblies described herein, mobile communication devices, alone or in combination, use audio detection jacks, components and/or software. Audio jack connectors are known in the art, and include, by way of example, Apple™ audio jacks, and audio jacks with microphones (http://www.freepatentsonline.com/y2010/0216526.html), and Intel™ brand HD audio components (http://en.wikipedia.org/wiki/Intel High Definition Audio) (a copy of which is attached hereto as Addendum A). Methodologies used herein include, by way of example those described in http://electronics.stackexchange.com/questions/1647/how-does-an-audio-jack-detect-when-a-speaker-is-plugged-in (a copy of which is attached hereto as Addendum B). Also used in the invention, are audio jack detection chips (in the assemblies, mobile phones, alone or in combination) which are commercially available from various vendors, e.g. http://www.wolfsonmicro.com/documents/uploads/misc/en/WAN0196.pdf (a copy of which is attached hereto as Addendum C), http://www.fairchildsemi.com/ds/FS/FSA8049.pdf (a copy of which is attached hereto as Addendum D) and http://pdfserv.maximintegrated.com/en/an/AN4607.pdf (a copy of which is attached hereto as Addendum). Further examples include mechanically modified audio jack connectors, radially isolated audio jack connectors in which the tip of the jack has isolation to allow controlling detection when longitudinal detection contacts, longitudinally isolated audio jacks in which the tip of the jack (with longitudinal isolation) allows controlling detection when detection contacts are facing each other on the side of the jack, and audio sockets or ports/methods/components that provide longitudinal detection, and audio sockets or ports/methods/components that provide facing detection contacts which are known in the art. These references are incorporated herein by reference, as if fully set forth herein.

Figure 3:
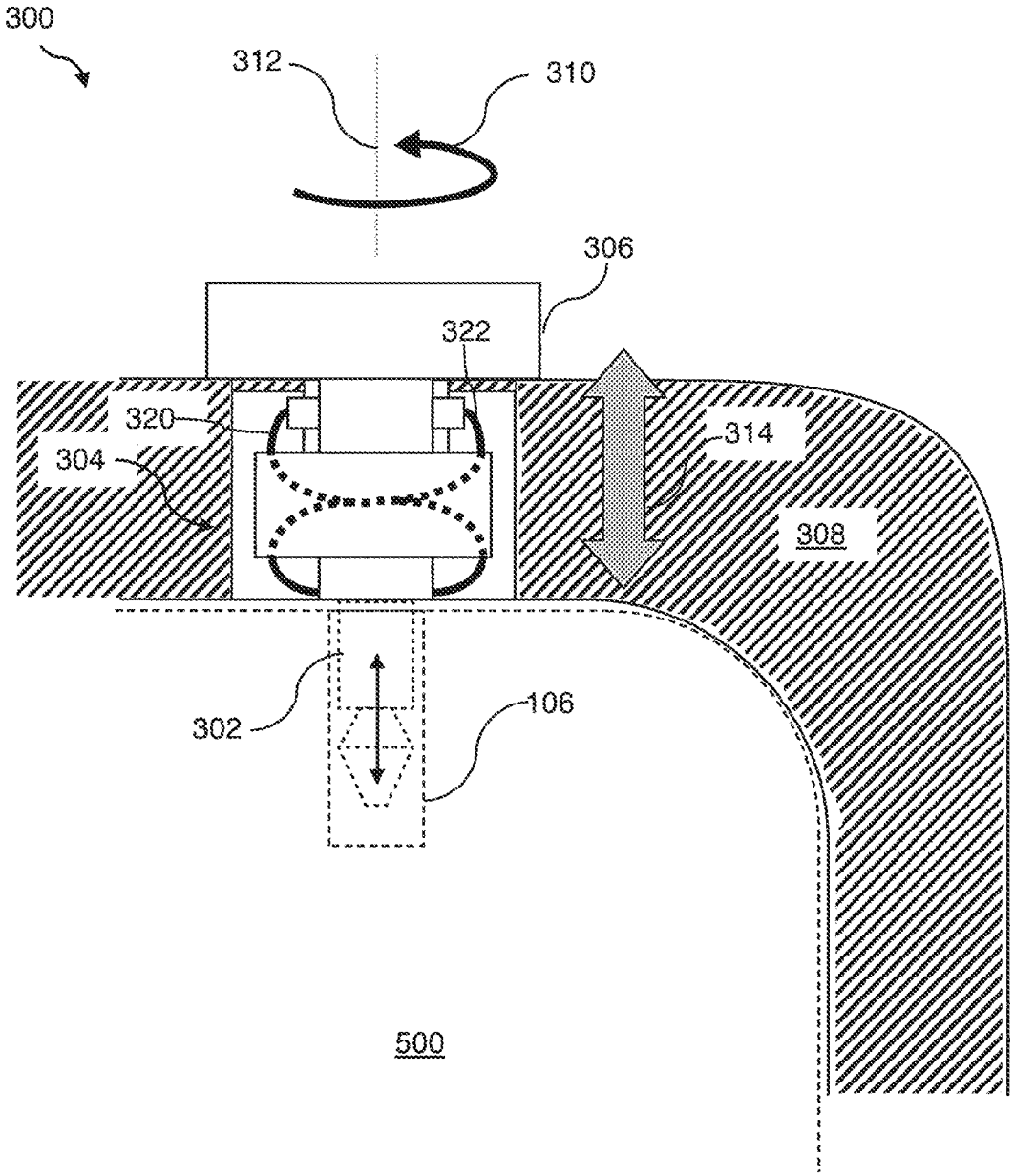
FIG. 3 is a partial front cut away view of a third variant of a mobile communications device case of the invention.
Figure 4:
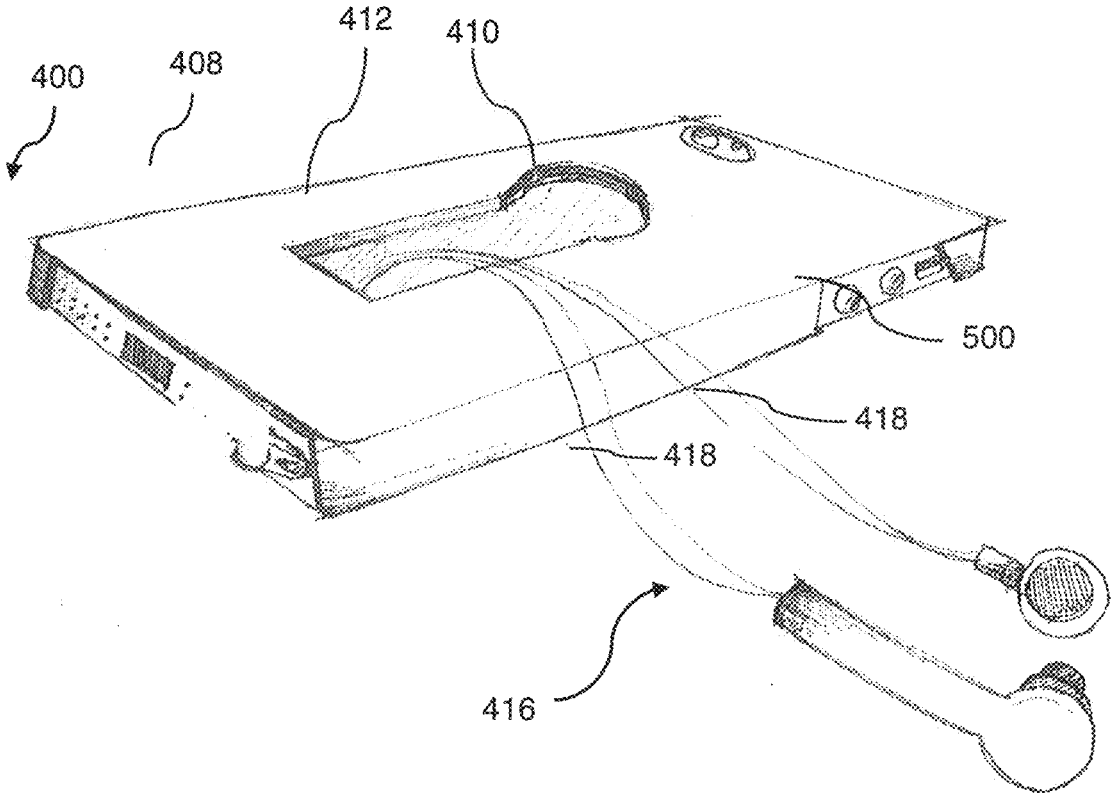
FIG. 4 is a rear perspective view of a fourth variant of a mobile communications device case of the invention.

The headphone male electrical connectors, e.g. male members, 102, 202, 302 do not typically form part of a headphone male connector assembly 104, 204, 304. The headphone male connector assembly is adapted to move a standard or standards compatible headphone male connector 102, 202, 302 to selectively mechanically engage a mobile communications device headphone port 106 (FIG. 1) to actuate the first audio configuration in a first position, and to actuate the second audio configuration in a second position. The headphone male connector assembly 104, 204, 304 is configured to move the headphone male connector 102, 202, 302 a distance in the range of about 1 millimeter to about 2 millimeters within the mobile communications device headphone port 106 (FIG. 1). While this forward and backward movement range within port 106 is shown as an example, it is possible that other distance ranges are covered either shorter or longer depending on the size and length of the male connector 102, 202, 302 or port 106 configuration. One should note that the male connector 102, 202, 302, in addition to providing the means for audio transmission from devices 500, also serves a secondary purpose of helping to lock mobile device 500 into case housings 108, 208, 308, 408. The case housing has multiple panels, including side panels, and a back panel which form a cavity in which the mobile device 500 removably fits. The housing can have one or more different cavities, e.g. one for the earbuds and one for the smartphone. It is appreciated that the headphone male connector assembly 104 is communicatively linked to an earbud assembly 410 (as shown in FIG. 4) via standard electrical connections and/or wiring. It is also appreciated that assemblies 104, 204, 304 are located within the interior of the case housings 108, 208, 308, respectively in one variant of the invention as illustrated in the partial front cut away views of FIGS. 1-3. In this regard, the front of the casing housings 108, 208, 308 are flush or substantially flush with the mobile communication device 500 touch screens to provide a desirable aesthetic appearance of the case 100, 200, 300 in relation to the mobile device 500, and eliminate the possibility of snagging a user's finger on the housing when using the mobile device with the respective case. Similarly, any protrusions or slides described herein can be located so that they are not flush (or optionally flush) with the exterior walls of the cases 100, 200, 300.

In yet another variant, the invention provides a male connector assembly 204 into which the male connector 202 can fully retreat so that it is flush with the inner wall 222 of housing 208. This may be accomplished by providing additional mechanical functionality to assembly 204 such that movement to a first position releases male connector 202 from inside of the housing assembly 204 into port 106. This can be accomplished after the mobile device 500 is inserted into the case. The male connector assembly then works in a second mode of operation where the male connector 202 only moves to actuate/de-actuate the handset/earbud mode of operation. In yet a further variant, the slide 210 permits the retraction/extension of the male connector into port 106 in yet another mode of operation. The male connector 202 can be retracted in order to permit ready removal of the mobile communication device 500. It is appreciated that male connector 202 may function to lock the mobile device into the case in this variant of the invention when it is extended into port 106. This provides an additional safeguard mechanism so that the phone does not fall out of the protective case 200. It is appreciated that the male connector 202 simultaneously mates with electrical components in port 106 to properly drive the handsets of the earbuds/earphones/headphones in the various modes of operation described herein.

As further illustrated in FIG. 4, the earbud assembly 410 (speakers and wires 418) is sized and dimensioned to fit within a cavity 410 on housing 408 in one variant of the invention. Optionally, the housing 408 is sized and dimensioned to accommodate a rechargeable lithium ion battery 412 for supplying auxiliary power to mobile communications device 500, in the event needed.

It should be noted that the earbud assembly 410 may be replaced by a separate microphone and loud speakers (which generally include an amplifier with external power source) without departing from the spirit and scope of the instant invention.

As shown in FIG. 2, headphone male connector assembly 204 is optionally communicatively linked to an earphone port assembly 206 located on the outer facing panel of housing 208 at a location other than that of headphone male connector assembly 104, 204, 304. It is further appreciated that this variant of the invention provides a plurality of audio jacks 234, 236, 238 (e.g. of the same type or of different types). Audio jacks 234, 236, 238 are communicatively, electrically, and/or selectively linked by individual or a plurality of audio cables 228, 230, 232 which are disposed in channel 240 within the housing. One or more of the audio/electrical cables/wires or connectors 228, 230, 232 exit channel 240 and may be communicatively, selectively and/or electrically mated with one or more electrical contacts (not shown—any number can be provided as can any number of audio jacks that are supported by the electrical contacts. One or more of the electrical contacts are activated as per user preference mechanically. The user can activate a single electrical contact or a plurality of electrical contacts to provide sound to one or more of the earbud set(s) or one or more of the earphone(s) sets through one or more of the female ports 234, 236 and/or 238. Electrical contacts or switches may be located within cavities 225, 227 of the housing. A plurality of electro/mechanical switches may be located within a respective channel 225, 227. The location can be on any one of the side panels of housing 208 taking into consideration the location of ports and buttons located on the mobile device. It is also appreciated that the invention provides a system that includes a combination of a protective case and two-way mobile communications/digital playback device described herein, and a method to assist in audio and/or audio-video management through the use of a combination of a mobile communications device and a protective case, e.g. smart phone, cellular phone, tablet computer. As discussed above, the protective case removably fits the mobile communications device. The method includes providing a plurality of protective case audio ports 234, 236 and 238 on the protective case. Each of the protective case audio ports 234, 236, 238 are capable of being selectively and electrically connected to a single audio port 106 on the mobile communications device 500. The method further includes providing at least one assembly (e.g. as illustrated in one variant of the invention in FIG. 2) on the protective case for selectively, electromechanically, and/or mechanically actuating and/or activating more than one of protective case audio ports 234, 236, 238.

For sake of clarity it is noted, that FIGS. 1-4 only illustrate partial views of the entire case that forms variants of the invention described herein. As shown in FIGS. 1 and 2, the headphone male connector assembly 104, 204 further includes a mechanical slide mechanism 110, 210 to actuate movement of the headphone male connector 102, 202. In one variant of the invention, a mechanical limit stop 120 is provided within a channel 120 in the housing to limit the mechanical slide mechanism's movement within a desired range of motion and for a predetermined forward and/or backward motion to adjust various settings and/or activate various audio jacks mechanically. Additional, mechanical, releasably interlocking grooves can be provided so that limit stop 120 moves to one or more desired positions releasably locking in place once a desired setting is achieved. A user moves the mechanical slide mechanisms 110, 210 as shown by arrows 116, 216 to actuate movement of male connectors 102, 202 in a forward or backward direction as shown by arrows 118, 218. The housings 108, 208 may include optional protuberances 120, 220 in which some or all parts of phone male connector assembly 104, 204 fit. The components of phone handset/microphone male connector assembly (to obtain movement) are varied, and may include by way of example springs, gears, flexible but axially rigid bands, and other mechanical members to assist in the translational movement of male connectors 102, 202, 302.

To assist in being able to switch between audio modes of operation quickly (e.g. with a single motion), slide assemblies 110, 210 are provided. It is appreciated that since unravelling earbuds is unnecessary, it is possible to bring the earbuds to the ear of a user in one variant of the invention in less than two seconds, and take less than 4 seconds to store the earbuds back in place. In another variant, the switch includes a bi-stable mechanical interface to pull the male connector connector by 1 to 2 mm in a single motion, and thus switch between earbuds/earphones/headphones and phone handset. The same action also works to pick up a new phone call. By way of example, the mechanical slide mechanism 110 is located on a first side 112 of the housing 108, and the headphone male connector 102 is located on a second side of the housing 114 as shown in FIG. 1. In another variant (FIG. 2), the mechanical slide mechanism 210 and the headphone male connector assembly 204 are co-located on a side 214 of the housing 208, in which one portion cams against another portion on cam surface 226, which is biased downward by spring 224.

In another example, the headphone male connector 302 assembly includes a rotational actuator 306. The rotational actuator 306 rotates in a circular fashion (forward or backward direction) as illustrated by arrow 310 around a center axis 312 of male connector 302 such that rotational movement of actuator 306 moves headphone male connector assembly 304 so that male connector 302 moves translationally along axis 312 as indicated arrow 314, e.g. backwards and forwards. A suitable helical channel 320 and cam 322 along with supporting wires and cables forming a cam assembly may be used to effect this motion as illustrated in FIG. 3. It is further appreciated that other mechanical assemblies of different types can also be used to achieve one or more desired settings through rotational motion of actuator 306.

It is further appreciated that the invention provides for a method used by a case for an electronic communications device for switching between an earphone/earbud mode of operation and a phone handset mode of operation. The method is accomplished mechanically by the user using the combination of the cases and mobile communications devices having the operational functionality described herein. By way of further example, case 100, 200, 300, 400 for the mobile communications device 500 is adaptable to take on at least two audio configurations. Of course, depending on the functionality of the smart phone software, other modes of functionality can be switched to or enabled or disabled using male connectors 102, 202, 302. This involves the apps running and the interfaces between the apps and ports and male connectors on the mobile device. As illustrated herein and by way of example, the first audio configuration is a handset configuration and the second audio configuration is an earbud configuration. As described earlier, the case has housings 108, 208, 308, 408 and a headphone male connectors 102, 202, 302 in various configurations. The headphone male connectors 102, 202, 302, form part of headphone male connector assemblies 104, 204, 304, and the headphone male connector assemblies are constructed to be capable of variably moving the headphone male connectors 102, 202, 302 between at least two positions. Of course, in other variants, the movement of male connectors 102, 202, 302 can go from one or more predetermined positions (longitudinally along a longitudinal axis of the connectors), and be changeably locked therein, or optionally the movement can be continually variable depending on the configuration of the assemblies 102, 202, 302.

The method includes providing for selective movement of the headphone male connectors 102, 202, 302 by a predetermined distance in a mobile communications device headphone port 106 (FIG. 1) to actuate the first audio configuration at a first position, and to actuate the second audio configuration at a second position. As mentioned above, not only can audio configurations be manually actuated using the invention, but depending on the mobile app, other features and functionality of the phone can be accessed and actuated using the method of the invention.

As shown in FIG. 3, the selective movement can include rotational movement of a rotational actuator 306 as illustrated by arrow 310. The movement can be clockwise or counter clockwise as desired to move the male connector 302 from one position to another and thus change the mode of operation of the mobile communications device 500 from one mode to another mode. In the variant illustrated in FIG. 2, the selective movement includes lateral movement (arrow 216) of a slide button via a mechanical slide assembly 210 so that the headphone male connector 202 moves in a direction perpendicular (arrow 218) to the lateral movement. As shown in FIG. 1, the selective movement may include translational movement (arrow 116) via button (moved with the thumb of a user) on slide assembly 110 to achieve parallel movement (arrow 118) of the headphone male connector 102 in port 106.

In another variant, and to assist in the method of the invention to speed switching between different modes of operation of the mobile devices 500, the method includes providing a cable management system on the housing 408. A cable management system can take many forms such as spring actuated cable retrieval systems, and the like. Alternatively, a user may simply remove, insert, or re-insert the cables 418 of earbud assembly 416 through an aperture on housing 408 into a cavity 410 for storage of earbud assembly 416. It is appreciated that the earbud assembly may be optionally hardwired into cases 100, 200, 300 and communicatively linked to the headphone male connector assembly 104, 204, 304. The cables of the earbud assembly can be variably extended to over 12 meters, and can be automatically retrieved into the interior of the housing 408 using known cable retrieve assemblies. The retrieval of the earbud assembly into the housing protects the earbuds from loss, and damage, thus providing additional convenience to the user while retaining as close as possible the design features of the original mobile communications device. Optionally, the earbuds assembly 416 includes an integrated microphone. It is appreciated that switching between phone handset mode and earphone/earbud mode (and picking up a call) can be accomplished in a single action by the user using the case and methods described herein.

In yet another variant, the invention provides for an audio management method used by the combination of a mobile communications device 500 and one of cases 100, 200, 300, 400, respectively. The cases 100, 200, 300, 400 removably fit the mobile communications devices 500. The method includes selectively switching between a headphone/earphone/earbuds mode of operation and a phone handset mode of operation via mechanical movement of headphone male connector 102, 202, 302 in a port 106 (FIG. 1) on the mobile communications devices 500, in which the headphone male connector forms part of a headphone male connector assembly 104, 204, 304 of the case 100, 208, 308. As described earlier, the mechanical movement is a movement in the range of about 1 to 2 millimeters, but of course other movement ranges are possible depending on the configurations of the mobile phone ports and male connectors that mate thereto. This functionality also provides a method that further includes picking up a call as a result of the mechanical movement.

It is also appreciated that the cable management system (not shown) can further optionally include a manually activated semi-automatic or automatic retrieval/extension system (not shown) for the earbud assembly 416. By way of example, where the earbud assembly 416 is extended, a tug on the one or more cables 418 of the assembly 416 actuates retrieval of the assembly 416 into cavity 410. Where the user is removing the earbud assembly 416, the automatic retrieval system permits the extension of the cables to a length, and then temporarily locks in place.

Earbuds, earphones, headphones and headsets are as used in the present invention case and method. Earbuds and earphones refer to very small headphones that are fitted directly in the outer ear, facing but not inserted in the ear canal. They have no band or other arrangement to fit over the head. Similarly, consumer-quality in-ear-canal speaker systems are also called earbuds. Outer-ear earphones are also used in the present invention in variants. In-ear headphones, like earbuds, are small and without a headband, and are inserted in the ear canal itself, and are used in other variants of the invention. These are also known as canal phones. Similarly, in-ear monitors (IEMs) are used herein. Canal phones that block out environmental noise by obstructing the ear canals are also used herein. Canal phones provide one or more stock silicone rubber, elastomer, or foam sleeves to fit various ear canals, for correct placement and best noise isolation. As is appreciated, any one of these types of speaker systems may be used with the present invention.

In a variant of the invention, a kit is provided that includes a case as described herein, one or more of silicone rubber, elastomer or foam sleeves of varying dimensions, cables and miniature speakers. By way of further example, these may include custom canal phones that are fitted to the ears of an individual user. In yet another variant, the invention is also used with a head set, which optionally includes an integrated microphone. Similarly, earbuds and in ear phones used herein incorporate a microphone in yet other variants of the invention, e.g. along the length of one or more of the cables 418. Similarly, volume modulators can also be located along the length of the one or more cables 418.

It should be appreciated that the particular implementations shown and herein described are representative of the invention and its best mode and are not intended to limit the scope of the present invention in any way. It is appreciated that one or more assemblies, methods, or protective housing features, can be used alone or in combination with one or more other assemblies, methods or protective housing features described herein.

It should be appreciated that many applications of the present invention may be formulated with more than one tablet computers and/or mobile phones. One skilled in the art will appreciate that the tablet computer/mobile phone network using the inventions described herein may include any system for exchanging data, such as, for example, the Internet, an intranet, an extranet, WAN, LAN, wireless network, satellite communications, and/or the like. It is noted that the network may be implemented as other types of networks, such as an interactive television network. The users may interact with the system via any input device such as a keyboard, mouse, kiosk, personal digital assistant, handheld computer, cellular phone and/or the like. Moreover, the system contemplates the use, sale and/or distribution of any goods, services or information having similar functionality described herein.

The computing units mentioned herein may be connected with each other via a data communication network. The network may be a public network and assumed to be insecure and open to eavesdroppers, or may also be secure. In one exemplary implementation, the network may be embodied as the Internet. In this context, the computers may or may not be connected to the Internet at all times.

As will be appreciated by skilled artisans, the present invention may be embodied as a system, a device, or a method. The present invention is described herein with reference to block diagrams, devices, components, and modules, according to various aspects of the invention. Moreover, the system contemplates the use, sale and/or distribution of any goods, services or information having similar functionality described herein.

The specification and figures should be considered in an illustrative manner, rather than a restrictive one and all modifications described herein are intended to be included within the scope of the invention claimed. Accordingly, the scope of the invention should be determined by the appended claims (as they currently exist or as later amended or added, and their legal equivalents) rather than by merely the examples described above. Steps recited in any method or process claims, unless otherwise expressly stated, may be executed in any order and are not limited to the specific order presented in any claim. Further, the elements and/or components recited in apparatus claims may be assembled or otherwise functionally configured in a variety of permutations to produce substantially the same result as the present invention. Consequently, the invention should not be interpreted as being limited to the specific configuration recited in the claims.

Benefits, other advantages and solutions mentioned herein are not to be construed as critical, required or essential features or components of any or all the claims. As used herein, the terms "comprises", "comprising", or variations thereof, are intended to refer to a non-exclusive listing of elements, such that any apparatus, process, method, article, or composition of the invention that comprises a list of elements, that does not include only those elements recited, but may also include other elements described in the instant specification. Unless otherwise explicitly stated, the use of the term "consisting" or "consisting of" or "consisting essentially of" is not intended to limit the scope of the invention to the enumerated elements named thereafter, unless otherwise indicated. Other combinations and/or modifications of the above-described elements, materials or structures used in the practice of the present invention may be varied or adapted by the skilled artisan to other designs without departing from the general principles of the invention. The patents and articles mentioned above are hereby incorporated by reference herein, unless otherwise noted, to the extent that the same are not inconsistent with this disclosure.

Other characteristics and modes of execution of the invention are described in the appended claims.

Further, the invention should be considered as comprising all possible combinations of every feature described in the instant specification, appended claims, and/or drawing figures which may be considered new, inventive and industrially applicable.

Copyright may be owned by the Applicant(s) or their assignee and, with respect to express Licensees to third parties of the rights defined in one or more claims herein, no implied license is granted herein to use the invention as defined in the remaining claims. Further, vis-à-vis the public or third parties, no express or implied license is granted to prepare derivative works based on this patent specification, inclusive of the appendix hereto and any computer program comprised therein.

Additional features and functionality of the invention are described in the claims appended hereto. Such claims are hereby incorporated in their entirety by reference thereto in this specification and should be considered as part of the application as filed. This patent application incorporates by reference, as if fully set forth herein, the subject matter in the ADDENDUM and Appendixes A-D, including any patents referenced therein.

Multiple variations and modifications are possible in the embodiments of the invention described here. Although certain illustrative embodiments of the invention have been shown and described here, a wide range of changes, modifications, and substitutions is contemplated in the foregoing disclosure. While the above description contains many specific details, these should not be construed as limitations on the scope of the invention, but rather exemplify one or another preferred embodiment thereof. In some instances, some features of the present invention may be employed without a corresponding use of the other features. Accordingly, it is appropriate that the foregoing description be construed broadly and understood as being illustrative only, the spirit and scope of the invention being limited only by the claims which ultimately issue in this application.

What is claimed is:

1. A case for a mobile communications device configurable to take on a hand set configuration and a headphone configuration, and the case having a housing, the case comprising:

a headphone male connector receptacle, the headphone male connector receptacle forming part of a headphone male connector assembly, the headphone male connector assembly located on a first side of the case adjacent a headphone jack of the mobile communications device;

a slider switch located on a second side of the case, perpendicular to the first side;

a connector assembly connecting the slider switch to the headphone male connector assembly and the connector assembly being moveable in a first direction to selectively engage a headphone male connector with a mobile communications device headphone port to actuate the headphone configuration in a first position, and the connector assembly being moveable in a second direction to selectively disengage a headphone male connector with a mobile communications device headphone port to actuate the hand set configuration in a second position.

2. The case of claim 1 in which the headphone male connector assembly is configured to move a headphone male connector a distance in the range of about 1 millimeter to about 2 millimeters within the mobile communications device headphone port.

3. The case of claim 1 in which the headphone male connector assembly is communicatively linked to an earbud assembly.

4. The case of claim 3 in which the earbud assembly is sized and dimensioned to fit within a cavity on the housing.

5. The case of claim 1 in which housing further comprises a rechargeable battery for supplying auxiliary power to the mobile communications device.

6. The case of claim 1 in which the headphone male connector assembly is communicatively linked to an earphone port located on the housing at a location other than that of the headphone male connector assembly.

7. A method effectuated by a protective case for an electronic communications device for switching between an headphone mode of operation and a phone handset mode of operation, the method comprising:

engaging a headphone male connector with a headphone male connector receptacle, the headphone male connector receptacle forming part of a headphone male connector assembly, the headphone male connector assembly located on a first side of the case adjacent a headphone jack of the mobile communications device;

moving a slider switch located on a second side of the case, perpendicular to the first side;

moving, with the slider switch, a connector assembly connecting the slider switch to the headphone male connector assembly and moving, the connector assembly in a first direction to selectively engage the headphone male connector with a mobile communications device headphone port to actuate the headphone configuration in a first position, and moving the slider switch and the connector assembly in a second direction to actuate the hand set configuration in a second position.

8. The method of claim 7 further comprising providing an earbuds cable management system on the housing to facilitate deployment and storage of the earbuds.

9. The method of claim 8 in which the cable management system further comprises a cavity for storing an earbud assembly.

10. The method of claim 9 in which the cable management system further comprises a manually activated automatic retrieval system for the earbud assembly, and wherein the earbud assembly is communicatively linked to the headphone male connector assembly.

11. The method of claim 7 in which the activation induces axial translation in the range of about 1 to about 2 millimeters.

12. A case for a mobile communications device configurable to take on a hand set configuration and a headphone configuration, and the case having a housing, the case comprising:

a headphone male connector receptacle, the headphone male connector receptacle forming part of a headphone male connector assembly, the headphone male connector assembly located on a first side of the case adjacent a headphone jack of the mobile communications device and having a cam surface;

a spring biasing the headphone male connector assembly;

a slider switch located on a second side of the case, perpendicular to the first side;

a connector assembly connected on a first side to the slider switch and having a second cam surface to engage the first cam surface of the to the headphone male connector assembly; and wherein when the slider switch is moved toward the headphone male connector assembly, the second cam surface engages the first cam surface to lift the headphone male connector out of the headphone jack to actuate the hand set mode; and wherein when the slider switch is moved away from the headphone male connector assembly, the second cam surface disengages the first cam surface to lower the headphone male connector into the headphone jack to actuate the headphone configuration.

13. The case of claim 12 further comprising:

the spring biasing the headphone male connector assembly toward the headphone jack to engage a headphone male connector with the headphone jack;

wherein when the slider switch is moved toward the headphone male connector assembly, the spring is compressed; and wherein when the slider switch is moved away from the headphone male connector assembly, the spring biases the headphone male connector into the headphone jack to actuate the headphone configuration.

* * * * *